US007341032B1

(12) United States Patent
Del Santo

(10) Patent No.: US 7,341,032 B1
(45) Date of Patent: Mar. 11, 2008

(54) DYNAMIC CAMSHAFT APPARATUS

(76) Inventor: Michael Steven Del Santo, 8139 Escola St., Navarre, FL (US) 32566

( * ) Notice: Subject to any disclaimer, the term of this patent is extended or adjusted under 35 U.S.C. 154(b) by 327 days.

(21) Appl. No.: 11/069,598

(22) Filed: Mar. 1, 2005

(51) Int. Cl.
*F01L 1/34* (2006.01)

(52) U.S. Cl. ..... 123/90.18; 123/90.6; 29/888.1

(58) Field of Classification Search ..... 123/90.15, 123/90.16, 90.17, 90.18, 90.27, 90.6; 29/888.1
See application file for complete search history.

(56) References Cited

U.S. PATENT DOCUMENTS 5,445,117 A * 8/1995 Mendler ..... 123/90.16
5,924,397 A * 7/1999 Moriya et al. ..... 123/90.18
6,474,281 B1 * 11/2002 Walters ..... 123/90.18

* cited by examiner

*Primary Examiner*—Ching Chang
(74) *Attorney, Agent, or Firm*—J. Nevin Shaffer, Jr.

(57) ABSTRACT

A dynamic camshaft apparatus includes, according to one embodiment, a moveable camshaft connected to an engine. The moveable camshaft has a first position when the engine is started and at low RPMs. Further, the moveable camshaft is conformed to move to different positions as the RPMs change.

6 Claims, 3 Drawing Sheets

DYNAMIC CAMSHAFT APPARATUS

FIELD OF THE INVENTION

This invention relates to camshafts. In particular, in machines with camshafts, according to one embodiment, the invention relates to a dynamic camshaft that has one position at start up and at low RPMs and that moves position as the RPMs change.

BACKGROUND OF THE INVENTION

The internal combustion engine includes a variety of common parts. In particular, machines of all types include a camshaft, lifters, timing belts or chains and so forth. The art and science of tuning a car, for example only and not by way of limitation, for peak performance has resulted in a variety of solutions. That is, some environments require maximum fuel economy and others require maximum torque. One prior art solution has been to provide a different camshaft for different situations. The camshaft includes lobes that contact tappets that move lifters, and so forth, all as known in the art. Different camshaft and lobe configurations result in different machine performance. The problem with these prior art solutions, however, is that replacement of the camshaft is a process that requires a skilled mechanic and is not something that a person unskilled in the art would even attempt. Nonetheless, even unskilled people desire machines that operate at peak performance in varying conditions.

Thus, there is a need in the art for providing a camshaft apparatus that is conformed to enable a machine to provide peak performance throughout a variety of operating conditions. It, therefore, is an object of this invention to provide an improved dynamic camshaft apparatus for enabling machines of every description to operate simply, easily, and seamlessly at peak performance through a variety of changing performance conditions.

SUMMARY OF THE INVENTION

The dynamic camshaft apparatus of the present invention includes, according to one embodiment, a movable camshaft connected to an engine. The movable camshaft has a first position when the engine is started and at low revolutions per minute (RPMs). Further, the movable camshaft is conformed to move to different positions as the RPMs change. According to another aspect of the invention, a camshaft stop is conformed to receive the movable camshaft. According to another aspect, camshaft lobes on the movable camshaft are sloped. According to another aspect, the apparatus includes tapered tappets that are conformed to contact the camshaft as the camshaft moves from one position to another. According to a further aspect, the tapered tappets further include a rolling ball contact point.

According to another aspect of the invention, at least one camshaft push spring is provided. According to a further aspect of this embodiment, the at least one camshaft push spring includes a front camshaft push spring and a rear camshaft push spring. According to another aspect, the camshaft stop further includes a plurality of tooth springs.

According to another embodiment of the invention, in an engine with a camshaft, a dynamic camshaft apparatus includes a movable camshaft connected to the engine wherein the movable camshaft has a first position when the engine is started and at low RPMs and wherein the movable camshaft is conformed to move to different positions as the RPMs change. A camshaft stop is provided that is conformed to receive the movable camshaft and camshaft lobes on the movable camshaft are sloped.

According to a further aspect of the invention, tapered tappets are provided and are conformed to contact the camshaft as the camshaft moves from one position to another. According to a further aspect of this invention, the tapered tappets include a rolling ball contact point. According to another aspect, at least one camshaft push spring is provided. According to a further aspect, the at least one camshaft push spring includes a front camshaft push spring and a rear camshaft push spring. According to another aspect, the camshaft stop includes a plurality of tooth springs.

According to another embodiment, a dynamic camshaft includes an engine to which a movable camshaft is connected. The movable camshaft has a first position when the engine is started and at low RPMs. Also, the movable camshaft is conformed to move to different positions as the RPMs change. Rolling ball contact tappets are provided and are conformed to contact the camshaft as the camshaft moves from one position to another.

According to another embodiment, a dynamic camshaft apparatus includes a movable camshaft with a point wherein the movable camshaft has a first position when the engine is started and at low RPMs. Further, the movable camshaft is conformed to move to different positions as the RPMs change. A camshaft stop is provided that is conformed to receive the point of the movable camshaft and the camshaft stop includes a plurality of tooth springs. The camshaft lobes on the movable camshaft are sloped and tapered ball point tappets are provided conformed to contact the camshaft as the camshaft moves from one position to another.

According to another aspect, at least one camshaft push spring is provided. According to a further aspect, the at least one camshaft push spring includes a front camshaft push spring and a rear camshaft push spring. According to another aspect, the slope of the camshaft lobes includes a high-end and a low end. According to another aspect, the movable camshaft includes a slip shaft.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
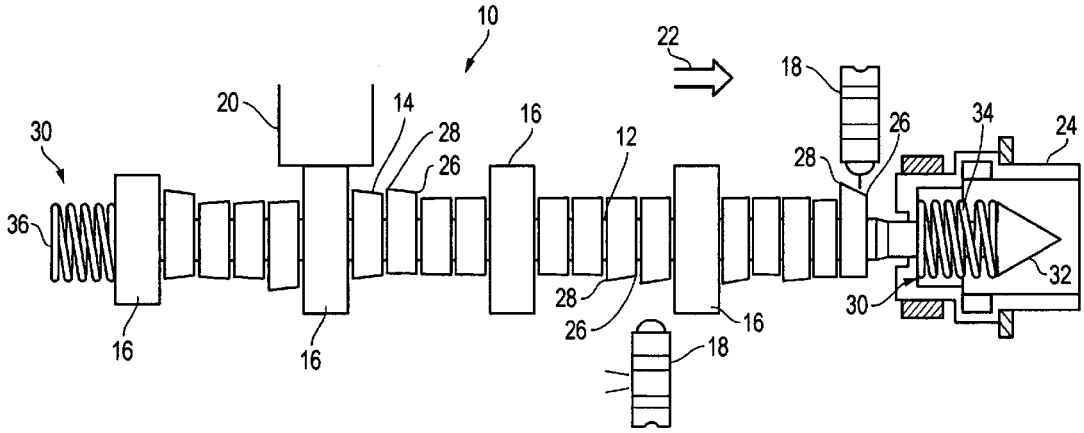
FIG. 1 is a side view of the dynamic camshaft apparatus of the present invention according to one embodiment.

An embodiment of the present invention is illustrated by way of example in FIGS. 1-6. With specific reference to FIG. 1, the dynamic camshaft apparatus 10 according to an embodiment of the present invention includes camshaft 12. Camshaft 12 includes lobes 14 and journals 16. Further, FIG. 1 illustrates tapered tappets 18. Tapered tappets 18 are connected to lifters (not shown), as is known in the art. Tapered tappets 18 contact lobes 14 as the camshaft 12 rotates, again as is known. Tapered tappets 18 will be more fully described with reference to FIG. 6 hereafter.

Camshaft 12 is connected to a machine engine (not shown) as is known in the art and held in rotational position by journal bearings 20, also as known. According to an important aspect of the invention and what is not known in the art, camshaft 12 is conformed to move in a linear direction while rotating in a normal fashion. Still referring to FIG. 1, when connected to an engine, camshaft 12 begins rotation at start up and at low RPMs at a start position (See for example FIG. 3, as more fully discussed hereafter). As the RPMs of camshaft 12 of the present invention increase, however, camshaft 12 moves from left to right in FIG. 1 in the direction of direction arrow 22 toward camshaft stop 24. Camshaft stop 24 will be more fully described hereafter with regard to FIGS. 2-5.

According to one aspect of the invention, camshaft 12 includes lobes 14 that are sloped. By "sloped" as that term is used herein it is meant that the lobes 14 are formed with a low end 26 and a high end 28 as illustrated. This is not to be confused with the tapered shape of the prior art lobes as is known. Instead, Applicant's lobes 14 when viewed as in FIG. 1, have a point on the lobe 14 that is the high end 28 and a point on the lobe 14 that is the low end 26 and the lobe 14 slopes between the high end 28 and the low end 26. Heretofore, all prior art lobes have had a single dimension with no part of the lobe higher or lower with regard to another. Again, for the purpose of complete description, prior art lobes are uniform in cross section. As illustrated in FIG. 1, however, in cross section, Applicant's sloped lobes 14 have a high end 28 and a low end 26.

Tapered tappets 18 ride along the sloped lobes 14 from low end 26 at start up to high end 28 at high RPMs. By determining what performance characteristics are desired, lobes 14 can be sloped to provide an exact range of performance characteristics in a single camshaft 12.

FIG. 1 also illustrates another embodiment of the present invention including at least one camshaft spring 30. Camshaft spring 30 is selected so as to assist in the movement of dynamic camshaft apparatus 10, camshaft 12 in operation in the direction of direction arrow 22. A front cam shaft spring 34 may be located at the end of camshaft 12 that comes to a point 32 as more fully illustrated in FIGS. 2 and 3. Further, a rear camshaft spring 36 may also be used when performance requirements dictate.

Figure 3:
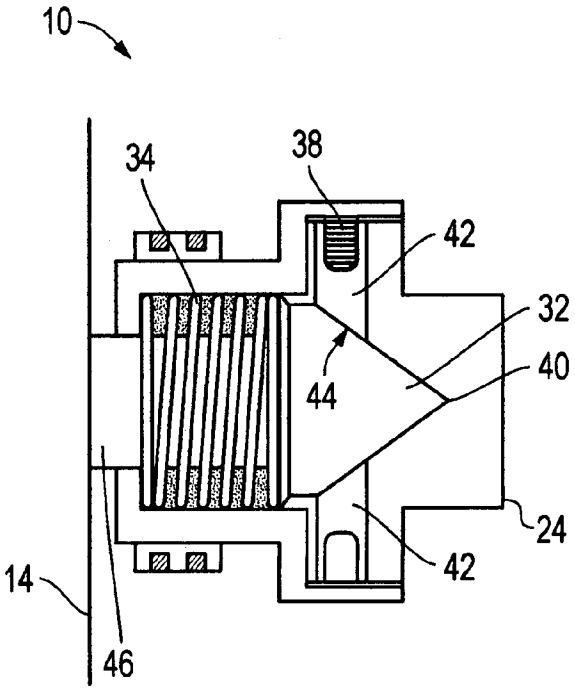
FIG. 3 is a side sectional view as in FIG. 1 wherein the point of the camshaft is fully received within the camshaft stop of the invention.
Figure 2:
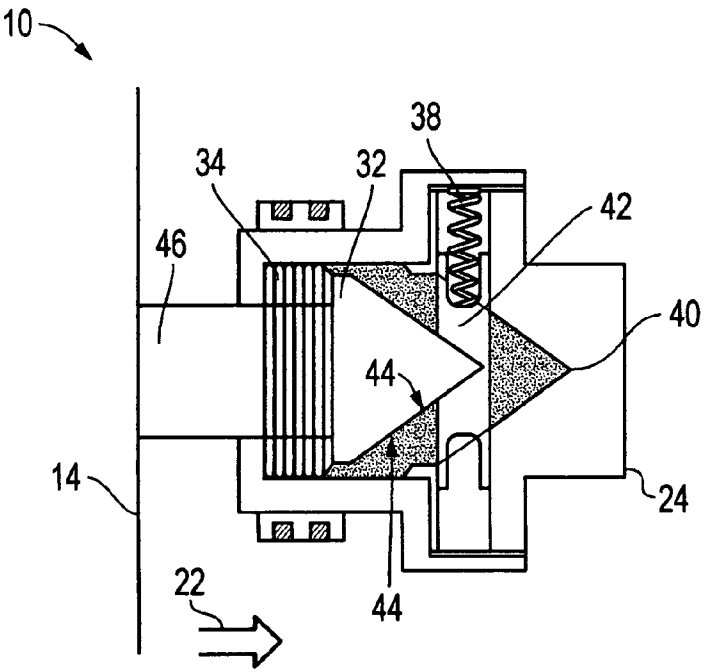
FIG. 2 is a side sectional view of the end of the camshaft invention of FIG. 1 at the startup and low RPM position.

Referring now to FIGS. 2 and 3, the operation and function of camshaft stop 24 is more fully described. According to one embodiment, camshaft stop 24 includes a plurality of tooth springs 38, as more fully described in FIGS. 4 and 5. Camshaft stop 24 also includes and absolute stop 40. At start up and at low RPMs, tooth springs 38 close off absolute stop 40 and keep point 32 of camshaft 12 in the start up/low RPM position shown in FIG. 2. For reference, note the position of first lobe 14 in FIG. 2. As shown in FIG. 1, tapered tappets 18 contact the low end 26 of lobe 14 in the start up/low RPM position. Camshaft stop 24 is restrained from any lateral movement in the direction of direction arrow 22 or in the opposite direction. Nonetheless, camshaft stop 24 does rotate in the same direction and at essentially the same speed as camshaft 12.

As the RPMs increase, centrifugal force acts upon tooth springs 38 and teeth 42 forcing the teeth 42 apart and compressing tooth springs 38 as illustrated. As the teeth 42 open, point 32 of camshaft 14 is allowed to move further toward absolute stop 40. As this happens, tapered tappets 18 ride up the slope on lobes 14 from low end 26 toward high end 28 thereby changing the performance characteristics of a machine dynamically, ie on the fly. In effect, multiple different cam shafts are represented in the dynamic camshaft apparatus 10 of the present invention as it moves and changes position.

If desired, front camshaft spring 34, and perhaps rear camshaft spring 36, also assist in moving camshaft 12 in the direction of direction arrow 22 as RPMs increase. At the highest RPMs point 32 is fully engaged within absolute stop 40 and further movement of camshaft 12 in the direction of direction arrow 22 is prevented. Thereafter, as RPMs decrease, the slanted faces 44 of point 32 and teeth 42, as illustrated, cooperate with tooth springs 38 and the decrease of centrifugal force to push camshaft 12 back toward the start up position in the opposite direction of direction arrow 22. When the RPMs are increased, the camshaft 12 moves accordingly so that the camshaft is in constant motion in response to the increase and decrease in the RPMs.

FIGS. 1-3 also illustrate an extended portion of camshaft 12, the slip shaft 46. Slip shaft 46 is a portion of the camshaft 12 without lobes 14. As shown in FIGS. 2 and 3, slip shaft 46 is, according to one aspect, engaged by front camshaft spring 34 and extends into camshaft stop 24 as shown from FIG. 2 to FIG. 3. Again the movement of dynamic camshaft apparatus 10 is also indicated by reference to the relative position of the lobe 14 in FIG. 2 and, after movement in the direction of direction arrow 22, to the position of lobe 14 in FIG. 3.

Figure 4:
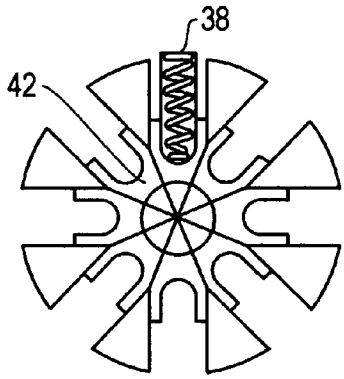
FIG. 4 is an end sectional view of the camshaft stop with a plurality of spring teeth in the closed and/or startup and low RPM position.
Figure 5:
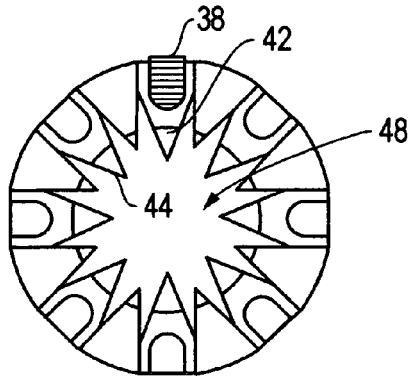
FIG. 5 is an end sectional view as in FIG. 4 illustrating the plurality of spring teeth of the camshaft stop in the fully extended and/or open position.

Referring now to FIGS. 4 and 5, a cross section of the tooth spring 38 construction is illustrated. FIG. 4 shows tooth spring 38 fully extended and, thus, forcing teeth 42 together along slanted faces 44 so as to close the opening of camshaft stop 24. FIG. 5 illustrates the effect of centrifugal force and the pressure of point 32 (not shown) against teeth 42 to force them apart and allow point 32 to penetrate opening 48 in the direction of absolute stop 40.

Figure 6:
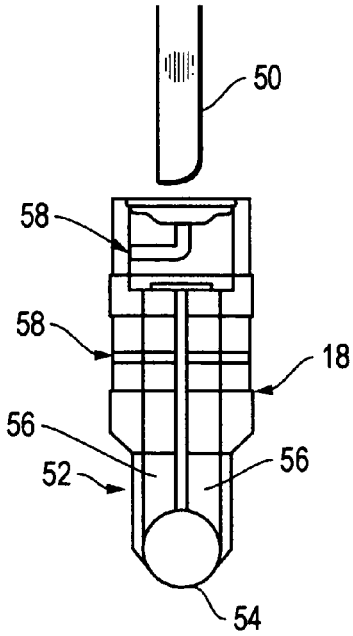
FIG. 6 is a side sectional view of the tapered ballpoint tappet according to one embodiment of the present invention.

Referring now to FIG. 6, tapered tappet 18 is more fully described. As is known, tapered tappet 18 cooperates with push rod 50 in operation. Applicant's tappet is tapered, however, so as to come to a narrow more slender end 52. Further, according to one embodiment of the invention, tapered tappet 18 includes a ball point 54. Ball point 54 is retained withing tapered tappet 18 by any means now known or hereafter developed such as by ball point retention rod 56 and is lubricated by means of oil holes 58. As illustrated, by way of Applicant's invention, ball point 54 greatly decreases the area in contact with lobe(s) 14 of the camshaft 12 and thus greatly reduces the friction normally found in the tappet-lobe interface. Further, unlike flat tappets or even so called roller tappets known in the art, Applicant's tapered ball point tappet 18 is free to move in the direction of direction arrow 22 (See FIGS. 1 and 2) and back again just as easily and smoothly.

By now, it should be clear to those of ordinary skill on the art that Applicant's dynamic camshaft apparatus 10 represents a dramatic improvement on prior art camshafts.

Machine operators no longer will be faced with choosing just one camshaft set up. By means of Applicant's dynamic camshaft apparatus 10, camshaft 12 is allowed to drift, so to speak, as the RPMs are increased. Slopped lobes 14, including low end 26 and high end 28, effectively change timing, duration, lift, and so forth. This greatly increases engine performance and efficiency as never before seen. That is to say, Applicant's dynamic camshaft apparatus 10 results in a general and over all improvement in engine performance. Applicant's dynamic camshaft apparatus 10 can be used in all types of engines: boats, industrial engines, NASCAR, trucking, military vehicles, airplanes, and any in all small engines. With very minimal testing, any type of ideal specifications can be constructed by means of combining the movement of camshaft 12 with the formation of slopped lobes 14 and the use of tapered tappets 18. The result, again, is improved engine performance in the nature of increased gas mileage, superior low-end torque, increased power through the entire RPM spectrum and the ability to effectively change timing while driving.

While the present invention has been disclosed in connection with the preferred embodiment thereof, it should be understood that there may be other embodiments which fall within the spirit and scope of the invention as defined by the following claims.

What is claimed is:

1. In an engine with a camshaft, a dynamic camshaft apparatus including:

a) a moveable camshaft with a point connected to said engine wherein said moveable camshaft has a first position when said engine is started and at low RPMs and wherein said moveable camshaft is conformed to move to different positions as the RPMs change;

b) a camshaft stop conformed to receive the point of said moveable camshaft wherein said camshaft stop further includes a plurality of tooth springs;

c) camshaft lobes on said moveable camshaft wherein said camshaft lobes are sloped; and d) tapered ball point tappets conformed to contact said camshaft as said camshaft moves from one position to another.

2. The apparatus of claim 1 further including at least one camshaft push spring.

3. The apparatus of claim 2 wherein said at least one camshaft push spring includes a front camshaft push spring and a rear camshaft push spring.

4. The apparatus of claim 1 wherein said slope of said camshaft lobes have a high end and a low end.

5. The apparatus of claim 1 wherein said moveable camshaft includes a slip shaft.

6. The apparatus of claim 1 wherein said tapered ball point tappets further include a rolling ball contact point.

* * * * *